US006382055B1

(12) United States Patent
Ross

(10) Patent No.: US 6,382,055 B1
(45) Date of Patent: May 7, 2002

(54) GAS WRENCH AND STORAGE THEREFOR

(76) Inventor: Donald Ross, 45350 Silverado La., Temecula, CA (US) 92592

( * ) Notice: Subject to any disclaimer, the term of this patent is extended or adjusted under 35 U.S.C. 154(b) by 0 days.

(21) Appl. No.: 09/871,804

(22) Filed: Jun. 1, 2001

(51) Int. Cl.[7] ..... B25B 13/00
(52) U.S. Cl. ..... 81/125.1; 81/176.1
(58) Field of Search ..... 81/125.1, 176.1

(56) References Cited

U.S. PATENT DOCUMENTS 4,603,658 A * 8/1986 Garnsey ..... 119/499
4,685,360 A * 8/1987 McCurdy ..... 81/119
5,456,278 A * 10/1995 Morris et al. ..... 137/1
5,806,384 A * 9/1998 Foster ..... 81/176.1
6,142,042 A * 11/2000 Geis ..... 81/119

* cited by examiner

*Primary Examiner*—Joseph J. Hail, III
*Assistant Examiner*—David B. Thomas
(74) *Attorney, Agent, or Firm*—Goldstein Law Offices, P.C.

(57) ABSTRACT

A gas wrench and storage therefor including a wrench portion having a first end portion and a second end portion. The first end portion has an angularly disposed slotted opening formed therein. The angularly disposed slotted opening is dimensioned for engaging a turn off valve of a gas meter. The second end portion has an aperture therethrough. A housing is positioned adjacent to the gas meter. The housing has a hook secured therein for positioning through the aperture of the second end portion of the wrench portion to support the wrench portion within the housing.

5 Claims, 2 Drawing Sheets

Fig. 1
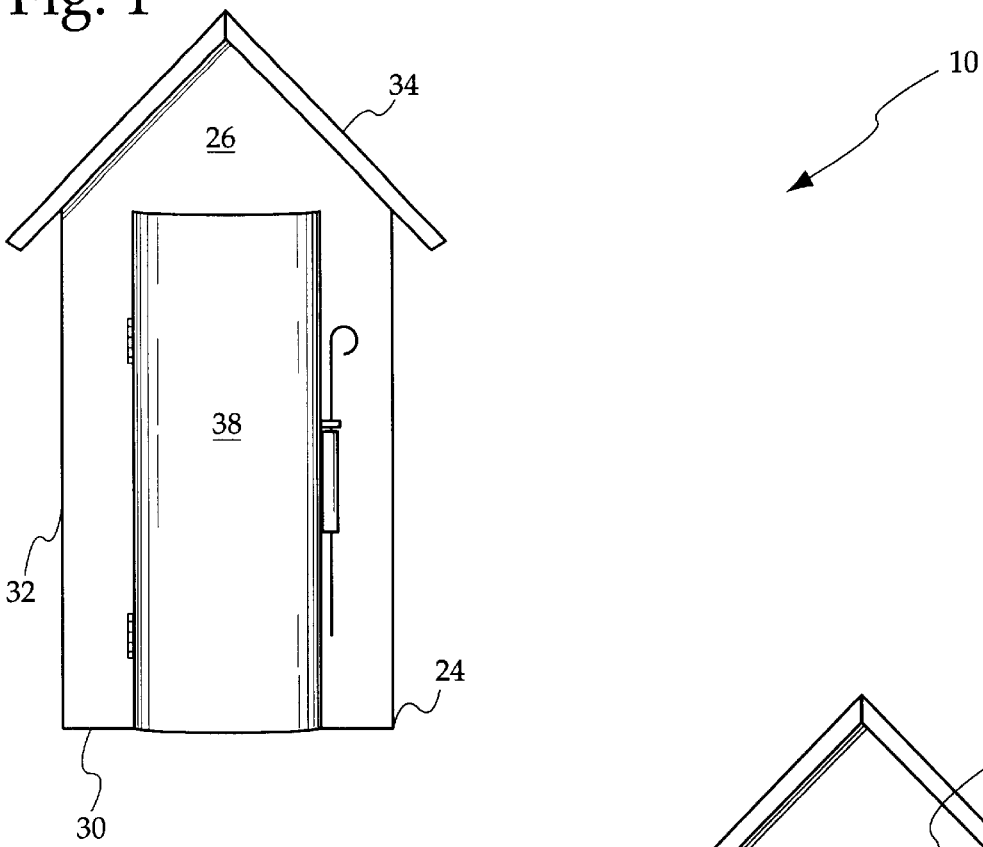
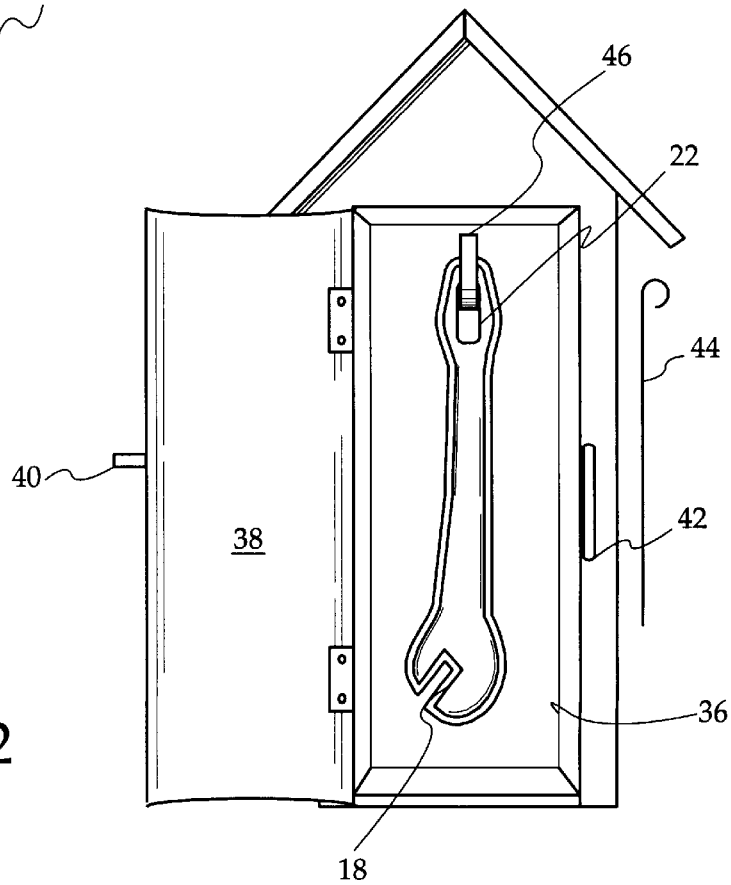
Fig. 2

GAS WRENCH AND STORAGE THEREFOR

BACKGROUND OF THE INVENTION

The present invention relates to a gas wrench and storage therefor and more particularly pertains to holding a gas wrench in immediate proximity to a gas meter in the event of a need for an emergency shut-off of gas.

The use of tools is known in the prior art. More specifically, tools heretofore devised and utilized for the purpose of performing a variety of maintenance functions are known to consist basically of familiar, expected and obvious structural configurations, notwithstanding the myriad of designs encompassed by the crowded prior art which have been developed for the fulfillment of countless objectives and requirements.

While these devices fulfill their respective, particular objective and requirements, these patents do not describe a gas wrench and storage therefor for holding a gas wrench in immediate proximity to a gas meter in the event of a need for an emergency shut-off of gas.

In this respect, the gas wrench and storage therefor according to the present invention substantially departs from the conventional concepts and designs of the prior art, and in doing so provides an apparatus primarily developed for the purpose of holding a gas wrench in immediate proximity to a gas meter in the event of a need for an emergency shut-off of gas.

Therefore, it can be appreciated that there exists a continuing need for a new and improved gas wrench and storage therefor which can be used for holding a gas wrench in immediate proximity to a gas meter in the event of a need for an emergency shut-off of gas. In this regard, the present invention substantially fulfills this need.

SUMMARY OF THE INVENTION

In the view of the foregoing disadvantages inherent in the known types of tools now present in the prior art, the present invention provides an improved gas wrench and storage therefor. As such, the general purpose of the present invention, which will be described subsequently in greater detail, is to provide a new and improved gas wrench and storage therefor which has all the advantages of the prior art and none of the disadvantages.

To attain this, the present invention essentially comprises a wrench portion having a first end portion and a second end portion. The first end portion has an angularly disposed slotted opening formed therein. The angularly disposed slotted opening is dimensioned for engaging a turn off valve of a gas meter. The second end portion has an aperture therethrough. A housing is positioned adjacent to the gas meter. The housing has a front wall, a back wall, a bottom wall, opposed side walls, and an angled roof disposed over an open top. The front wall has an opening therethrough. The opening has a door hingedly coupled thereto. The door has a lock associated therewith. The lock includes a small open-ended cylinder secured to a free edge of the door. The lock includes a corresponding large open-ended cylinder secured to the front wall. The small cylinder is linearly aligned with the large cylinder when the door is closed for removably receiving a locking pin therethrough. An interior surface of the back wall has a hook secured thereto for positioning through the aperture of the second end portion of the wrench portion to support the wrench portion within the housing.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved gas wrench and storage therefor which has all the advantages of the prior art tools and none of the disadvantages.

It is another object of the present invention to provide a new and improved gas wrench and storage therefor which may be easily and efficiently manufactured and marketed.

It is a further object of the present invention to provide a new and improved gas wrench and storage therefor which is of durable and reliable construction.

An even further object of the present invention is to provide a new and improved gas wrench and storage therefor which is susceptible of a low cost of manufacture with regard to both materials and labor, and which accordingly is then susceptible of low prices of sale to the consuming public, thereby making such a gas wrench and storage therefor economically available to the buying public.

Even still another object of the present invention is to provide a new and improved gas wrench and storage therefor for holding a gas wrench in immediate proximity to a gas meter in the event of a need for an emergency shut-off of gas.

Lastly, it is an object of the present invention to provide a new and improved gas wrench and storage therefor including a wrench portion having a first end portion and a second end portion. The first end portion has an angularly disposed slotted opening formed therein. The angularly disposed slotted opening is dimensioned for engaging a turn off valve of a gas meter. The second end portion has an aperture therethrough. A housing is positioned adjacent to the gas meter. The housing has a hook secured therein for positioning through the aperture of the second end portion of the wrench portion to support the wrench portion within the housing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the gas wrench and storage therefor constructed in accordance with the principles of the present invention.

FIG. 2 is a front view of the present invention illustrating an interior of the housing with the gas wrench positioned therein.

The same reference numerals refer to the same parts through the various figures.

DESCRIPTION OF THE PREFERRED EMBODIMENT

Figure 4:
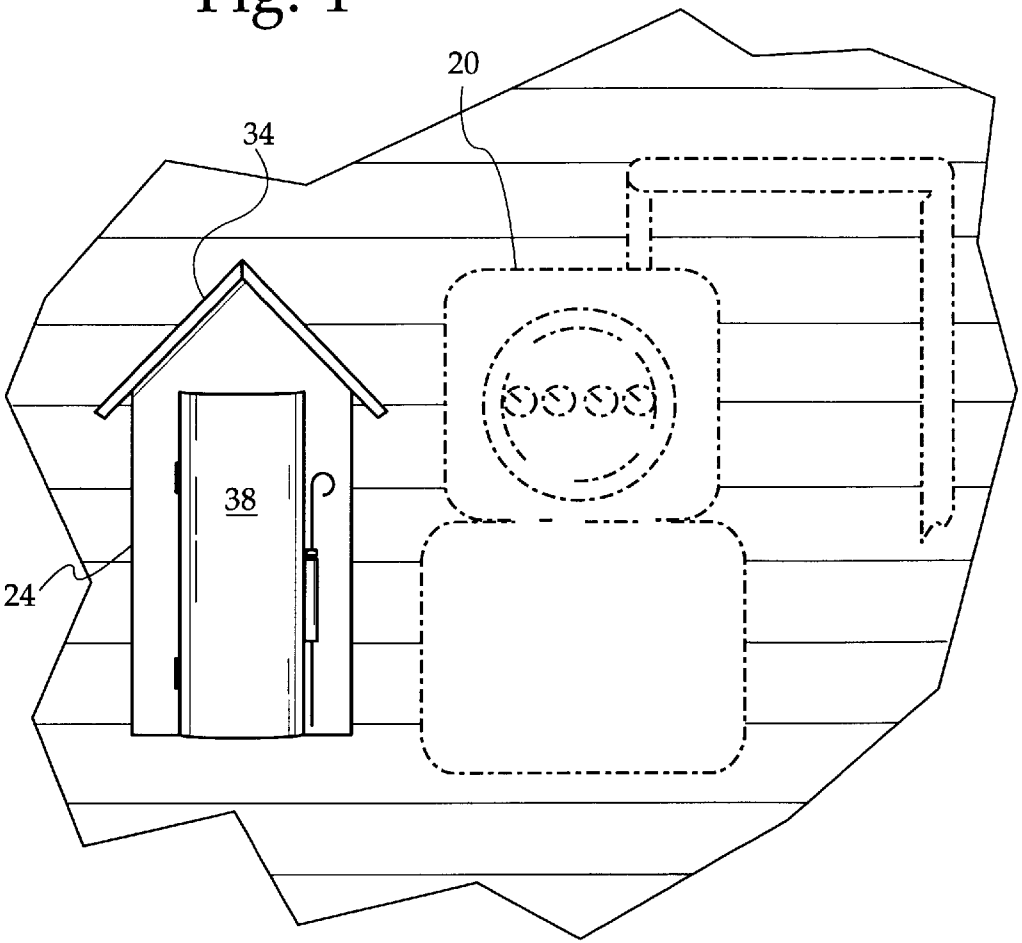
FIG. 4 is a front view of the present invention illustrated in place next to a gas meter.
Figure 3:
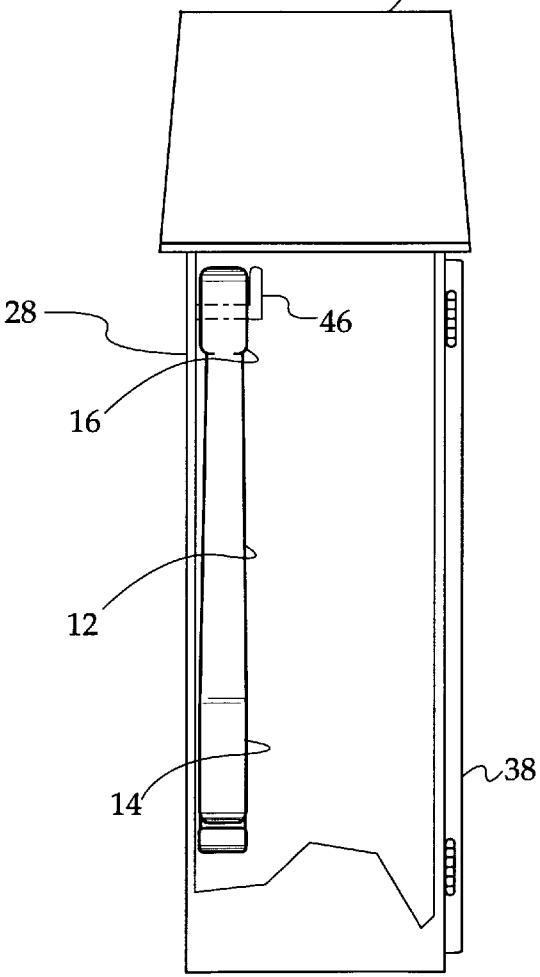
FIG. 3 is a side view of the present invention illustrating an interior of the housing with the gas wrench positioned therein.

With reference now to the drawings and in particular, to FIGS. 1 through 4 thereof, the preferred embodiment of the new and improved gas wrench and storage therefor embodying the principles and concepts of the present invention and generally designated by the reference number 10 will be described.

Specifically, it will be noted in the various figures that the device relates to a gas wrench and storage therefor for holding a gas wrench in immediate proximity to a gas meter in the event of a need for an emergency shut-off of gas. In its broadest context, the device consists of a wrench portion and a housing. Such components are individually configured and correlated with respect to each other so as to attain the desired objective.

The wrench portion 12 has a first end portion 14 and a second end portion 16. The first end portion 14 has an angularly disposed slotted opening 18 formed therein. The angularly disposed slotted opening 18 is dimensioned for engaging a turn off valve of a gas meter 20. The second end portion 16 has an aperture 22 therethrough. The wrench portion 12 is a tool designed specifically for engaging the turn off valve of the gas meter 20 so that the gas can be shut down quickly in the event of an emergency.

The housing 24 is positioned adjacent to the gas meter 20. The housing 24 has a front wall 26, a back wall 28, a bottom wall 30, opposed side walls 32, and an angled roof 34 disposed over an open top. The front wall 26 has an opening 36 therethrough. The opening 36 has a door 38 hingedly coupled thereto. The door 38 has a lock associated therewith. The lock includes a small open-ended cylinder 40 secured to a free edge of the door 38. The lock includes a corresponding large open-ended cylinder 42 secured to the front wall 26. The small cylinder 40 is linearly aligned with the large cylinder 42 when the door 38 is closed for removably receiving a locking pin 44 therethrough. An interior surface of the back wall 28 has a hook 46 secured thereto for positioning through the aperture 22 of the second end portion 16 of the wrench portion 12 to support the wrench portion 12 within the housing 24.

In case of an emergency, the locking pin 44 is first removed, allowing the door 38 to be opened exposing the interior of the housing 24. The user can then reach into the housing 24 to remove the wrench portion 12 from the hook 46 and be able to quickly attach the wrench portion 12 to the shut off valve of the gas meter 20 to turn the gas off and avert a potential gas leak or explosion.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A gas wrench and storage therefor for holding a gas wrench in immediate proximity to a gas meter in the event of a need for an emergency shut-off of gas comprising, in combination:

a wrench portion having a first end portion and a second end portion, the first end portion having an angularly disposed slotted opening formed therein, the angularly disposed slotted opening being dimensioned for engaging a turn off valve of a gas meter, the second end portion having an aperture therethrough; and a housing positioned adjacent to the gas meter, the housing having a front wall, a back wall, a bottom wall, opposed side walls, and an angled roof disposed over an open top, the front wall having an opening therethrough, the opening having a door hingedly coupled thereto, the door having a lock associated therewith, the lock including a small open-ended cylinder secured to a free edge of the door, the lock including a corresponding large open-ended cylinder secured to the front wall, the small cylinder being linearly aligned with the large cylinder when the door is closed for removably receiving a locking pin therethrough, an interior surface of the back wall having a hook secured thereto for positioning through the aperture of the second end portion of the wrench portion to support the wrench portion within the housing.

2. A gas wrench and storage therefor for holding a gas wrench in immediate proximity to a gas meter in the event of a need for an emergency shut-off of gas comprising, in combination:

a wrench portion having a first end portion and a second end portion, the first end portion having an angularly disposed slotted opening formed therein, the angularly disposed slotted opening being dimensioned for engaging a turn off valve of a gas meter, the second end portion having an aperture therethrough; and a housing positioned adjacent to the gas meter, the housing having a hook secured therein for positioning through the aperture of the second end portion of the wrench portion to support the wrench portion within the housing.

3. The gas wrench and storage therefor as set forth in claim 2, wherein the housing has a front wall, a back wall, a bottom wall, opposed side walls, and an angled roof disposed over an open top, the front wall having an opening therethrough, the opening having a door hingedly coupled thereto.

4. The gas wrench and storage therefor as set forth in claim 3, wherein the door has a lock associated therewith.

5. The gas wrench and storage therefor as set forth in claim 4, wherein the lock includes a small open-ended cylinder secured to a free edge of the door, the lock including a corresponding large open-ended cylinder secured to the front wall, the small cylinder being linearly aligned with the large cylinder when the door is closed for removably receiving a locking pin therethrough.

* * * * *